US006435312B2

(12) United States Patent
Tajima et al.

(10) Patent No.: US 6,435,312 B2
(45) Date of Patent: Aug. 20, 2002

(54) ELEVATOR SPEED CONTROLLER RESPONSIVE TO POWER FAILURES

(75) Inventors: Shinobu Tajima; Hiroshi Araki; Ikuro Suga; Kazuyuki Kobayashi, all of Tokyo (JP)

(73) Assignees: Mitsubishi Denki Kabushiki Kaisha, Tokyo (JP); The Tokyo Electric Power Company, Inc, Tokyo (JP)

( * ) Notice: Subject to any disclaimer, the term of this patent is extended or adjusted under 35 U.S.C. 154(b) by 0 days.

(21) Appl. No.: 09/785,236

(22) Filed: Feb. 20, 2001

(30) Foreign Application Priority Data

Feb. 28, 2000 (JP) ..... 2000-052345

(51) Int. Cl.[7] ..... B66B 1/06
(52) U.S. Cl. ..... 187/290; 187/296; 318/801
(58) Field of Search ..... 187/290, 296, 187/391; 318/798–815, 375, 376

(56) References Cited

U.S. PATENT DOCUMENTS

| | | | | |
|---|---|---|---|---|
| 3,585,482 A | * | 6/1971 | Zelina | 320/35 |
| 4,456,097 A | * | 6/1984 | Salihi | 318/727 |
| 4,554,999 A | * | 11/1985 | Kamike | 187/29 R |
| 4,666,020 A | * | 5/1987 | Watanabe | 187/114 |
| 5,058,710 A | * | 10/1991 | Iwasa | 187/114 |
| 5,698,823 A | * | 12/1997 | Tanahashi | 187/296 |
| 6,121,740 A | * | 9/2000 | Gale et al. | 318/376 |
| 6,315,081 B1 | * | 11/2001 | Yeo | 187/290 |

FOREIGN PATENT DOCUMENTS

| | | |
|---|---|---|
| JP | 5-338947 | 12/1993 |
| JP | 10-67469 | 3/1998 |

OTHER PUBLICATIONS

U.S. patent application Ser. No. 09/741,159, Tajima et al., filed Dec. 21, 2000.
U.S. patent application Ser. No. 09/742,894, Tajima et al., filed Dec. 21, 2000.

* cited by examiner

*Primary Examiner*—Jonathan Salata
(74) *Attorney, Agent, or Firm*—Leydig Voit & Mayer, Ltd

(57) ABSTRACT

A controller of an elevator for smooth speed control, using a cheap power accumulating device having a low capacity, even during a power failure. The controller has a converter, an inverter, a power accumulating device arranged between DC buses, a charging-discharging control circuit for controlling charging and discharging of the power accumulating device, a power failure detector, a current measuring instrument and a voltage measuring instrument for respectively detecting an output current and an output voltage of the inverter, a car load measuring instrument, an encoder, and a speed control circuit for controlling operation of the inverter, which has a table with required power set according to speed and car load, and calculates the power required from the table on the basis of a measured car load and a detected speed during a power failure, and also calculates speed commands for controlling the speed of the elevator within a range of discharging ability of the power accumulating device on the basis of a comparison of the output power of the inverter, the power required, and the discharging ability.

9 Claims, 10 Drawing Sheets

FIG. 3

T1

| | | CAR LOAD | | | |
|---|---|---|---|---|---|
| | | FOR NO LOAD | FOR 10 % LOAD | · · · | FOR FULL LOAD |
| SPEED | V1 | WS11 | WS21 | | WSn1 |
| | V2 | WS21 | WS22 | | |
| | ⋮ | ⋮ | ⋮ | · · · | |
| | Vn | WSn1 | WSn2 | | WSnn |

FIG. 5

T2

| PRESENT DISCHARGING CURRENT | DISCHARGING VOLTAGE | PRESENT DISCHARGING VOLTAGE = OUTPUT ABILITY POWER Wo |
|---|---|---|
| A1 AMPERE | V11 VOLT | — |
| | V12 VOLT | A11 AMPERE |
| | V13 VOLT | A13 AMPERE |
| | | |
| | | |
| | | |
| | | |
| | | |
| | | |

FIG. 7

T3

| TEMPERATURE | LIMIT DISCHARGING CURRENT |
|---|---|
| : | : |
| : | : |
| : | : |
| : | : |

FIG. 8

T4

| CHARGING DEGREE (SOC) | LIMIT DISCHARGING CURRENT |
|---|---|
| : | : |
| : | : |
| : | : |
| : | : |

FIG. 9

T5

| TIME | FOR NO LOAD | FOR 10 % LOAD | | FOR FULL LOAD |
|---|---|---|---|---|
| t1 | V01 | V11 | | V101 |
| t2 | V02 | V12 | | V102 |
| t3 | V03 | V13 | | V103 |
| | | | | |
| | | | | |
| | | | | |
| tn | V0n | V1n | | V10n |

ELEVATOR SPEED CONTROLLER RESPONSIVE TO POWER FAILURES

BACKGROUND OF THE INVENTION

1. Field of the Invention

This invention relates to a controller of an elevator of an energy saving type to which a secondary battery is applied.

2. Description of the Related Art

FIG. 10 is a view showing the basic construction of a controller for controlling the operation of an elevator by applying a conventional secondary battery thereto.

In FIG. 10, reference numerals 1 and 2 respectively designate a three-phase AC power source and a converter constructed by a diode, etc. and converting AC power outputted from the three-phase AC power source 1 to DC power. The DC power converted by the converter 2 is supplied to a DC bus 3. The operation of an inverter 4 is controlled by a speed controller for controlling a speed position of the elevator and described later. A direct current supplied through the DC bus 3 is converted to an alternating current of predetermined desirable variable voltage and variable frequency and an AC motor 5 is driven so that a hoisting machine 6 of the elevator directly connected to the AC motor 5 is rotated. Thus, a rope 7 wound around the hoisting machine 6 controls elevating and lowering operations of a car 8 and a counterweight 9 connected to both ends of this rope 7 and passengers within the car 8 are moved to a predetermined stage floor.

Here, weights of the car 8 and the counterweight 9 are designed such that these weights are approximately equal to each other when passengers half a number limit ride in the car 8. Namely, when the car 8 is elevated and lowered with no load, a power running operation is performed at a lowering time of the car 8 and a regenerative operation is performed at a elevating time of the car 8. Conversely, when the car 8 is lowered in the number limit riding, the regenerative operation is performed at the lowering time of the car 8 and the power running operation is performed at the elevating time of the car 8.

An elevator control circuit 10 is constructed by a microcomputer, etc., and manages and controls an entire operation of the elevator. A power accumulating device 11 is arranged between DC buses 3 and accumulates power at the regenerative operation time of the elevator, and supplies the accumulated power to the inverter 4 together with the converter 2 at the power running operation time. The power accumulating device 11 is constructed by a secondary battery 12 and a DC-DC converter 13 for controlling charging and discharging operations of this secondary battery 12.

Here, the DC-DC converter 13 has a voltage lowering type chopper circuit and a voltage raising type chopper circuit. The voltage lowering type chopper circuit is constructed by a reactor 13*a,* a gate 13*b* for charging current control connected in series to this reactor 13*a,* and a diode 13*c* connected in reverse parallel to a gate 13*d* for discharging current control described later. The voltage raising type chopper circuit is constructed by the reactor 13*a,* the gate 13*d* for discharging current control connected in series to this reactor 13*a,* and a diode 13*e* connected in reverse parallel to the above gate 13*b* for charging current control. Operations of the gate 13*b* for charging current control and the gate 13*d* for discharging current control are controlled by a charging-discharging control circuit 15 on the basis of a measuring value from a charging-discharging state measuring device 14 for measuring charging and discharging states of the power accumulating device 11 and a measuring value from a voltage measuring instrument 18. A current measuring instrument arranged between the secondary battery 12 and the DC-DC converter 13 is used as the charging-discharging state measuring device 14 in this conventional example.

A gate 16 for regenerative current control and a regenerative resistor 17 are arranged between DC buses 3. The voltage measuring instrument 18 measures the voltage of a DC bus 3. A regenerative control circuit 19 is operated on the basis of regenerative control commands from a speed control circuit described later. The gate 16 for regenerative current control is constructed such that an ON pulse width is controlled on the basis of control of the regenerative control circuit 19 when a measuring voltage provided by the voltage measuring instrument 17 is equal to or greater than a predetermined value at the regenerative operation time. Regenerated power is discharged in the regenerative resistor 17 and is converted to thermal energy and is consumed.

An encoder 20 is directly connected to the hoisting machine 6. The speed control circuit 21 controls a position and a speed of the elevator by controlling an output voltage and an output frequency of the inverter 4 on the basis of speed commands and a speed feedback output from the encoder 22 based on commands from the elevator control circuit 10.

An operation of the controller having the above construction will next be explained.

At a power running operation time of the elevator, power is supplied to the inverter 4 from both the three-phase AC power source 1 and the power accumulating device 11. The power accumulating device 11 is constructed by the secondary battery 12 and the DC-DC converter 13, and an operation of this power accumulating device 11 is controlled by the charging-discharging control circuit 15. In general, the number of secondary batteries 12 is reduced as much as possible and an output voltage of each secondary battery 12 is lower than the voltage of the DC bus 3 so as to make the controller compact and cheaply construct the controller. The voltage of the DC bus 3 is basically controlled near a voltage provided by rectifying a three-phase AC of the three-phase AC power source 1. Accordingly, it is necessary to lower the bus voltage of the DC bus 3 at a charging time of the secondary battery 12 and raise the bus voltage of the DC bus 3 at a discharging time of the secondary battery 12. Therefore, the DC-DC converter 13 is adopted. Operations of the gate 13*b* for charging current control and the gate 13*d* for discharging current control in this DC-DC converter 13 are controlled by the charging-discharging control circuit 15.

FIGS. 11 and 12 are flow charts showing controls of the charging-discharging control circuit 15 at its discharging and charging times.

The control of the charging-discharging control circuit 15 at the discharging time shown in FIG. 11 will first be explained.

A current control minor loop, etc. are constructed in voltage control of a control system and the control operation may be more stably performed. However, for simplicity, the control of the charging-discharging control circuit 15 is here explained by a control system using the bus voltage.

First, the bus voltage of the DC bus 3 is measured by the voltage measuring instrument 17 (step S11). The charging-discharging control circuit 15 compares this measuring voltage with a predetermined desirable voltage set value and judges whether the measuring voltage exceeds the voltage set value or not (step S12). If no measuring voltage exceeds the set value, the charging-discharging control circuit 15 next judges whether the measuring value of a discharging current of the secondary battery 12 provided by the charging-discharging state measuring device 14 exceeds a predetermined value or not (step S13).

When the measuring voltage exceeds the set value by these judgments, or when the measuring value of the discharging current of the secondary battery 12 exceeds the predetermined value even if no measuring voltage exceeds the set value, an adjusting time DT is subtracted from the present ON time to shorten an ON pulse width of the gate 13*d* for discharging current control and a new gate ON time is calculated (step S14).

In contrast to this, when it is judged in the above step S13 that no measuring value of the discharging current of the secondary battery 12 provided by the measuring device 14 exceeds the predetermined value, a new gate ON time is calculated by adding the adjusting time DT to the present ON time so as to lengthen the ON pulse width of the gate 13*d* for discharging current control (step S15). Thus, ON control of the gate 13*d* for discharging current control is performed on the basis of the calculated gate ON time, and the calculated gate ON time is stored to a built-in memory as the present ON time (step S16).

Thus, more electric current flows from the secondary battery 12 by lengthening the ON pulse width of the gate 13*d* for discharging current control. As a result, supply power is increased and the bus voltage of the DC bus 3 is increased by power. When the power running operation is considered, the elevator requires the power supply and this power is supplied by discharging the secondary battery 12 and by the three-phase AC power source 1. When the bus voltage is controlled such that this bus voltage is higher than an output voltage of the converter 2 supplied from the three-phase AC power source 1, all power is supplied from the secondary battery 12. However, the controller is designed such that all power is not supplied from the secondary battery 12, but is supplied from the secondary battery 12 and the three-phase AC power source 1 in a suitable ratio so as to cheaply construct the power accumulating device 11.

Namely, in FIG. 11, the measuring value of the discharging current is compared with a supply allotment corresponding current (predetermined value). If this measuring value exceeds the predetermined value, the ON pulse width of the gate 13*d* for discharging current control is lengthened and a supply amount is further increased. In contrast to this, when no measuring value of the discharging current exceeds the predetermined value, the ON pulse width of the gate 13*d* for discharging current control is shortened and the power supply is clipped. Thus, since power supplied from the secondary battery 12 is clipped among power required in the inverter 4, the bus voltage of the DC bus 3 is reduced so that the power supply from the converter 2 is started. These operations are performed for a very short time so that a suitable bus voltage is actually obtained to supply required power of the elevator. Thus, power can be supplied from the secondary battery 12 and the three-phase AC power source 1 in a predetermined desirable ratio.

The control of the charging-discharging control circuit 15 at the charging time shown in FIG. 12 will next be explained.

When there is power regeneration from the AC motor 5, the bus voltage of the DC bus 3 is increased by this regenerated power. When this voltage is higher than an output voltage of the converter 2, the power supply from the three-phase AC power source 1 is stopped. When there is no power accumulating device 11 and this stopping state is continued, the voltage of the DC bus 3 is increased. Therefore, when a measuring voltage value of the voltage measuring instrument 17 for detecting the bus voltage of the DC bus 3 reaches a certain predetermined voltage, the regenerative control circuit 19 is operated and closes the gate 16 for regenerative current control. Thus, power flows through the regenerative resistor 17 and the regenerated power is consumed and the elevator is decelerated by electromagnetic braking effects. However, when there is the power accumulating device 11, this power is charged to the power accumulating device 11 by the control of the charging-discharging control circuit 15 with a voltage equal to or smaller than a predetermined voltage.

Namely, as shown in FIG. 12, if the measuring value of the bus voltage of the DC bus 3 provided by the voltage measuring instrument 17 exceeds the predetermined voltage, the charging-discharging control circuit 15 detects that it is a regenerative state, and increases a charging current to the secondary battery 12 by lengthening the ON pulse width of the gate 13*b* for charging current control (step S21→S22→S23). When the regenerated power from the elevator is reduced in a short time, the voltage of the DC bus 3 is also correspondingly reduced and no measuring value of the voltage measuring instrument 17 exceeds the predetermined voltage. Accordingly, the ON pulse width of the gate 13*b* for charging current control is shortly controlled and charging power is also reduced and controlled (step S21→S22→S24).

Thus, the bus voltage is controlled in a suitable range and a charging operation is performed by monitoring the bus voltage of the DC bus 3 and controlling the charging power. Further, energy is saved by accumulating and re-utilizing power conventionally consumed in the regenerated power. When no power of a charger is consumed for certain reasons such as a breakdown, etc., the above regenerative control circuit 19 is operated as a backup and the regenerated power is consumed by a resistor so that the elevator is suitably decelerated. In a general elevator for housing, the regenerated power is about 2 KVA and is about 4 KVA at its maximum decelerating value although this regenerated power is different in accordance with a capacity of the elevator, etc.

The regenerative control circuit 19 monitors the voltage of the DC bus 3. If this voltage is equal to or greater than a predetermined value, the ON pulse width of the gate 16 for regenerative current control is controlled by the regenerative control circuit 19 so as to discharge the above power in the regenerative resistor 17 so that the regenerated power flows through the regenerative resistor 17. There are various kinds of systems for controlling this pulse width, but the pulse width is simply controlled in accordance with the following formula. Namely, when the voltage of the DC bus 3 for starting turning-on of the gate 16 for regenerative current control is set to VR, a flowing current IR can be simply calculated by turning-on (closing) a circuit since a resistance value of the regenerative resistor 17 is already known. Further, maximum power to be flowed is already known. Therefore, if this maximum power (VA) is set to WR, it is sufficient to generate an ON pulse of duty of WR/(VR×IR) while the DC bus voltage is monitored. However, an object of this construction is to consume all regenerated power in the regenerative resistor 17.

However, the power accumulating device 11 is cheaply constructed in the above conventional controller of the elevator. Therefore, when the power accumulating device 11 is capable of supplying power sufficient to operate the elevator in any load condition upon failure of commercial power, this power accumulating device becomes expensive. Accordingly, when there is no supply of the commercial power upon a power failure, it is impossible to sufficiently supply operating power for the elevator requiring maximum running power for up-driving with a full load. Therefore, the elevator must be operated at a low speed at which the elevator can run in all operating modes.

SUMMARY OF THE INVENTION

To solve the above problems, an object of this invention is to provide a controller of an elevator capable of performing smooth speed control even during a power failure, using a cheap power accumulating device having a low capacity.

To achieve this object, a controller of an elevator in this invention comprises a converter for rectifying AC power from an AC power source and converting the AC power to DC power; an inverter for converting the DC power from the converter to AC power of a variable voltage and a variable frequency and driving an electric motor and operating the elevator; a power accumulating device arranged between DC buses between the converter and the inverter, and accumulating DC power from the DC buses at a regenerative operation time of the elevator, and supplying the accumulated DC power at a power running operation time to the DC buses; a charging-discharging control device for controlling charging and discharging operations of the power accumulating device with respect to the DC buses; power failure detecting means for detecting a power failure; current detecting means for detecting an output current of the inverter; voltage detecting means for detecting an output voltage of the inverter; car load measuring means arranged in a car of the elevator and measuring a car load; speed detecting means for detecting an operating speed of the elevator; and speed control means for controlling an operation of the inverter to perform speed control based on speed commands and a detecting value provided by the speed detecting means of the elevator; the controller being characterized in that the speed control means has a table set with required power in accordance with the speed and the car load; and output power of the inverter is calculated on the basis of a detected current value of the current detecting means and a detected voltage value of the voltage detecting means at a time of power failure detection using the power failure detecting means; and the required power is calculated from the table on the basis of a car load measuring value measured by the car load measuring means and a detecting speed detected by the speed detecting means; and the speed commands for performing the speed control are calculated within a range of discharging ability power on the basis of comparison of the calculated output power of the inverter, the calculated required power and the discharging ability power of the power accumulating device.

Further, a fixed value is set as the discharging ability power of the power accumulating device in the speed control means.

Further, the controller further comprises charging-discharging state measuring means for measuring at least one of a temperature, charging and discharging currents and charging and discharging voltages of the power accumulating device, and the speed control means has a table set with a limited discharging current with respect to the discharging current and the discharging voltage, and the limited discharging current is calculated from the table on the basis of measuring values of the discharging current and the discharging voltage from the charging-discharging state measuring means, and the discharging ability power of the power accumulating device is calculated from the calculated limited discharging current and the measuring value of the discharging voltage.

Further, the speed control means has a table set with the limited discharging current with respect to the temperature, and the limited discharging current is calculated from the table on the basis of a measuring value of the temperature from the charging-discharging state measuring means, and the discharging ability power of the power accumulating device is calculated from the calculated limited discharging current and the measuring value of the discharging voltage.

Further, the speed control means has a table set with the limited discharging current with respect to a charging degree as a value obtained by normalizing and accumulating a product of a charging-discharging current and a charging-discharging voltage by a capacity with a full charging state of the power accumulating device as a reference, and the limited discharging current is calculated from the table on the basis of the charging degree obtained on the basis of the measuring values of the discharging current and the discharging voltage from the charging-discharging state measuring means, and the discharging ability power of the power accumulating device is calculated from the calculated limited discharging current and the measuring value of the discharging voltage.

Further, the speed control means has a table set with a speed pattern in accordance with a load state, and the speed pattern is calculated from the table on the basis of a car load measuring value measured by the car load measuring means, and the speed commands according to the calculated speed pattern are generated.

Further, the power failure detecting means detects the power failure of the AC power source.

Further, the power failure detecting means detects the power failure on the basis of a detecting voltage of the DC buses.

Further, the speed control means continues acceleration if the elevator is accelerated when the discharging ability power is larger than the output power of the inverter.

BRIEF DESCRIPTION OF THE DRAWINGS

FIG. 3 is an explanatory view of a table in a speed control circuit in an embodiment 1 of this invention in which required power is set in accordance with a load and a speed of a car.

FIG. 5 is an explanatory view of a table in a speed control circuit in an embodiment 2 of this invention in which a limited discharging current is set with respect to a discharging current and a discharging voltage.

FIG. 7 is an explanatory view of a table T3 arranged in a speed control circuit in an embodiment 3 of this invention in which a limited discharging current is set with respect to the temperature of a secondary battery of a power accumulating device.

FIG. 8 is an explanatory view of a table in a speed control circuit in an embodiment 4 of this invention in which a limited discharging current is set with respect to a charging degree of the power accumulating device.

FIG. 9 is an explanatory view of a table in a speed control circuit in an embodiment 5 of this invention in which a speed pattern according to a load state is set.

DESCRIPTION OF THE PREFERRED EMBODIMENTS

In this invention, when consumed power of an elevator already exceeds discharging ability power from a power accumulating device, an operation of the elevator is controlled such that such that an elevator target speed is reduced and using power is reduced. Thus, the using power lies within a power range able to be supplied from the power accumulating device. Further, at this time, there is a possibility of generation of regenerative power in accordance with a load state of a car. While this regenerative power is small, the regenerative power is accumulated in the power accumulating device, but when the regenerative power increases, the regenerative power is consumed by a regenerative resistor and the using power is reduced.

Figure 1:
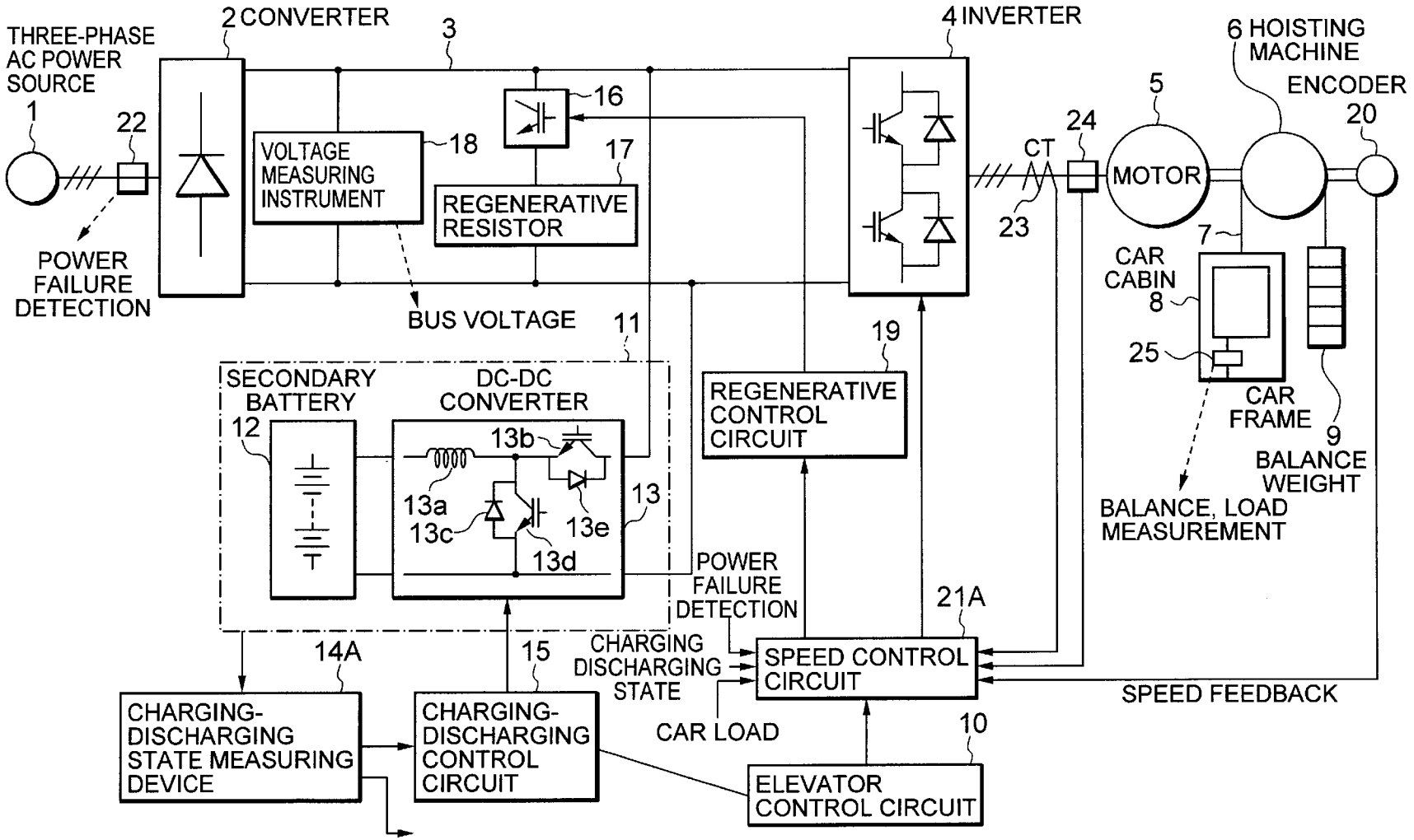
FIG. 1 is a block diagram showing the construction of a controller of an elevator according to the invention.
Figure 10:
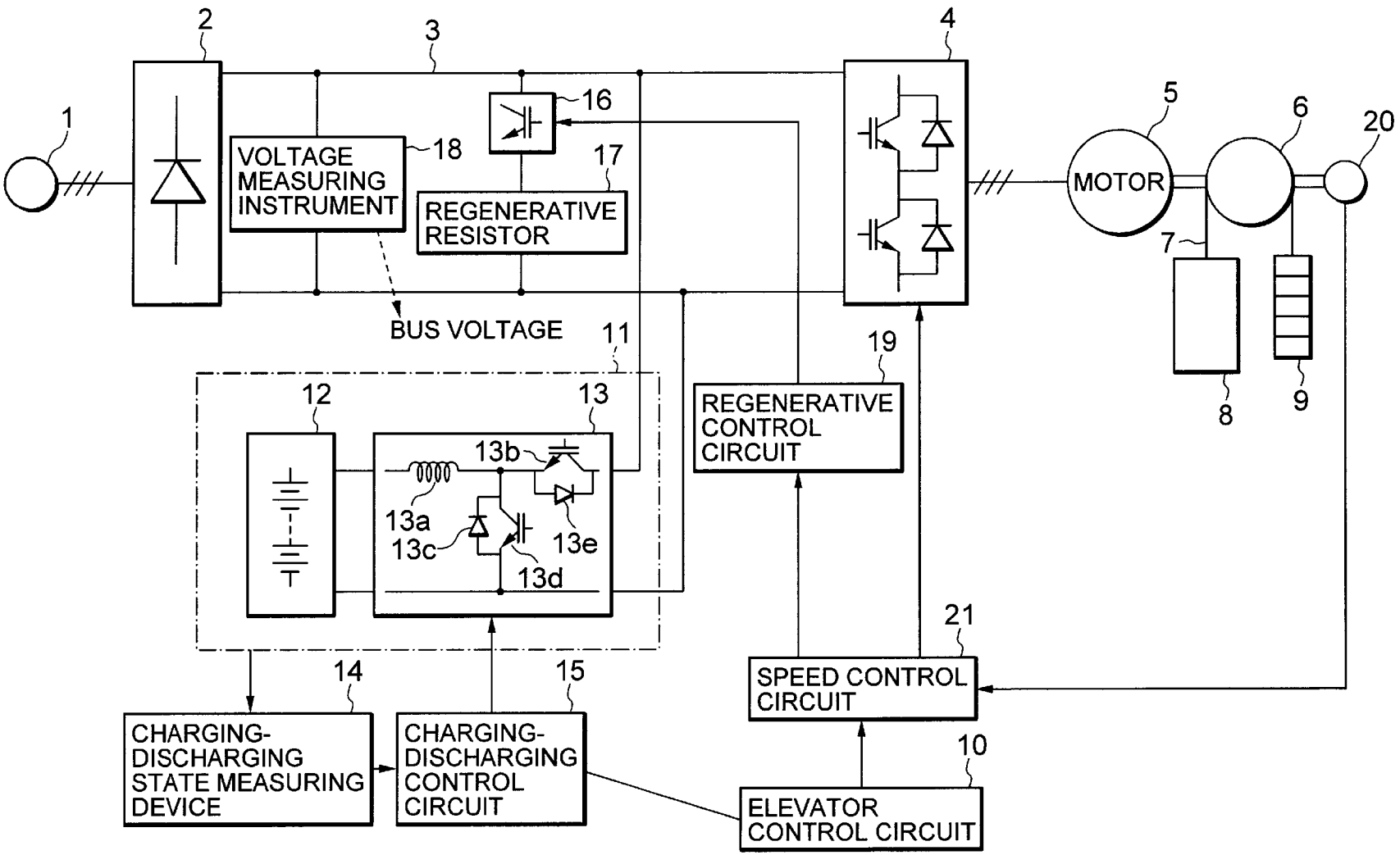
FIG. 10 is a block diagram showing the construction of a controller of an elevator in a conventional example.
Figure 11:
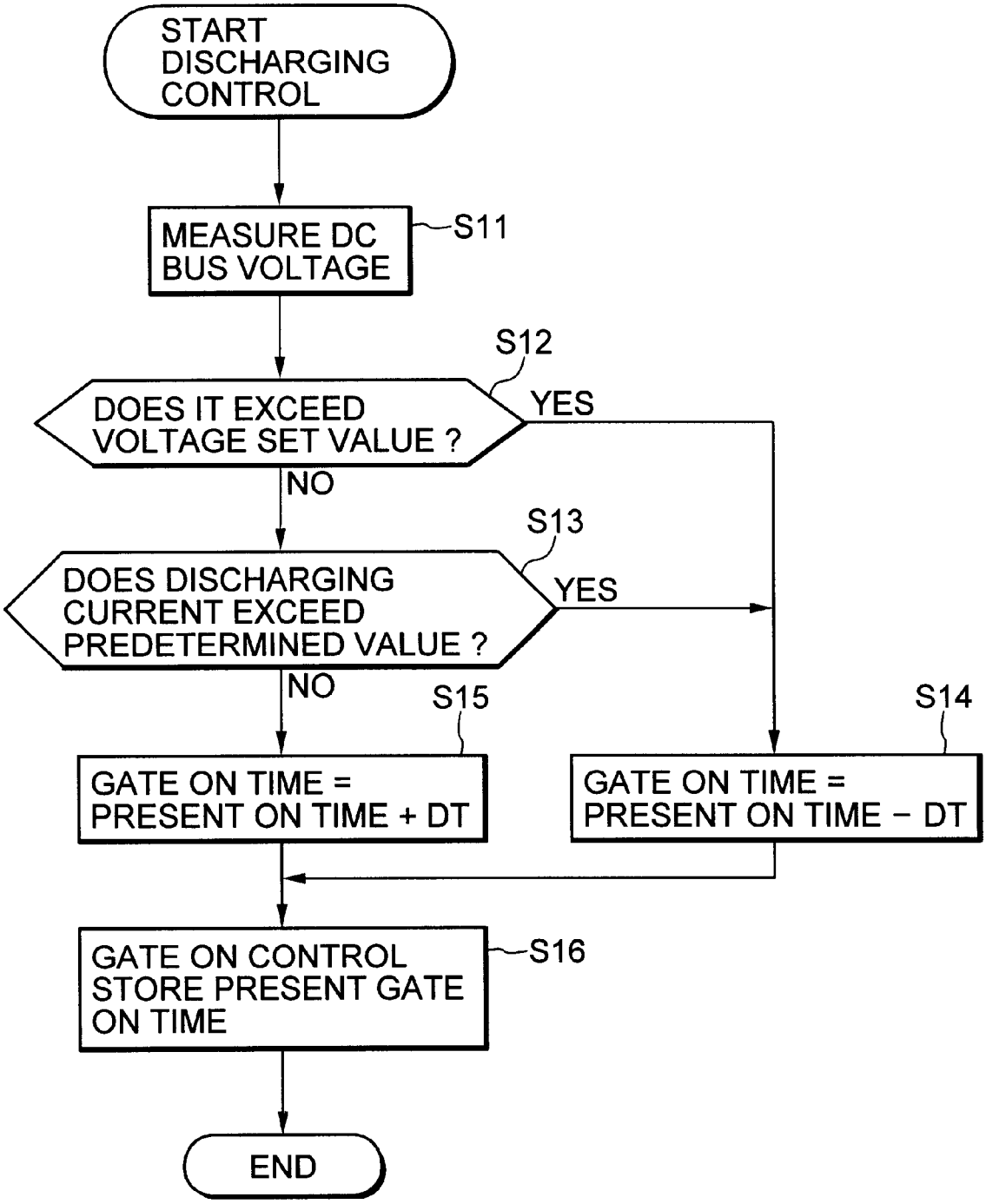
FIG. 11 is a flow chart showing the control of a charging-discharging control circuit shown in FIG. 10 during discharging.
Figure 12:
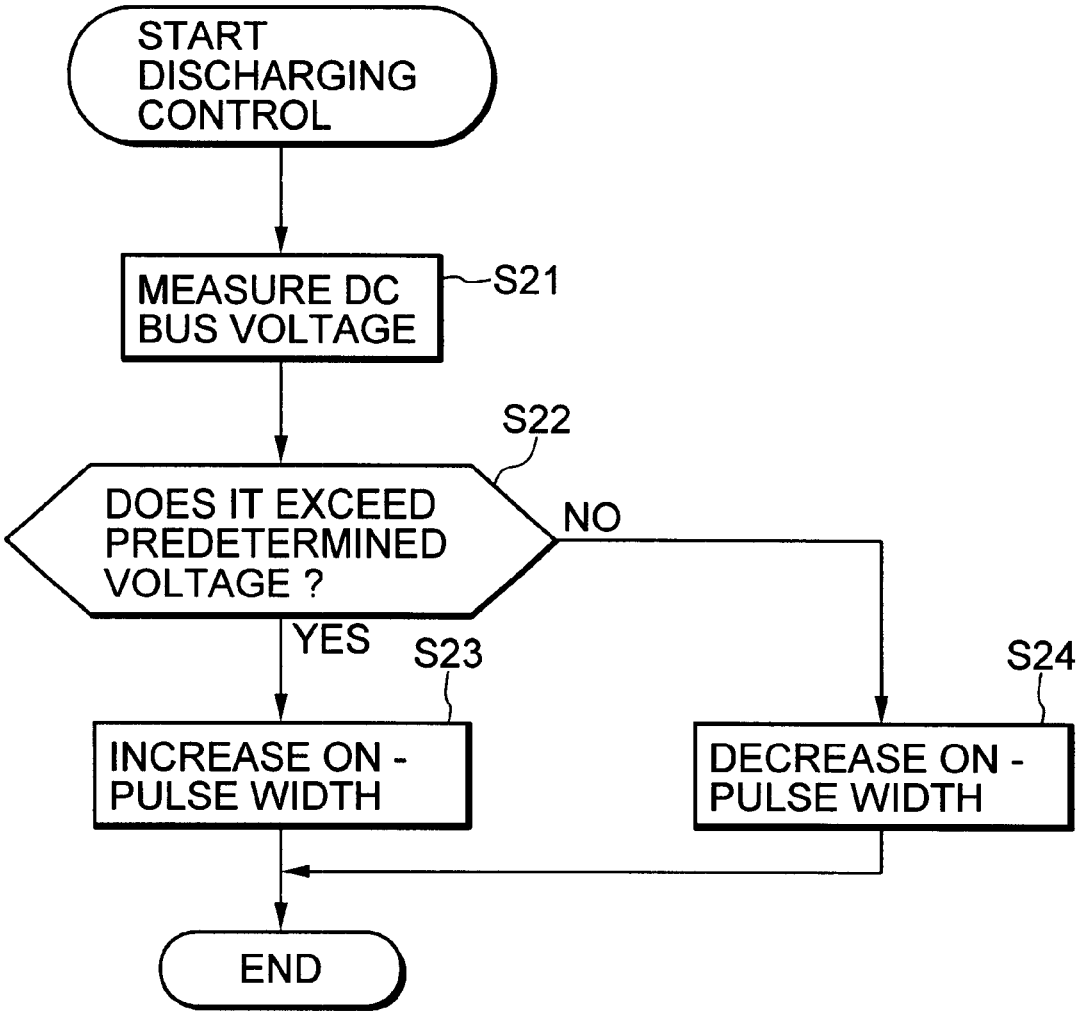
FIG. 12 is a flow chart showing the control of the charging-discharging control circuit shown in FIG. 10 during charging.

FIG. 1 is a block diagram showing the construction of a controller of the elevator in this invention. In FIG. 1, the same components as the conventional example shown in FIG. 10 are designated by the same reference numerals and their explanations are omitted here. New reference numerals 14A and 21A respectively designate a charging-discharging state measuring device and a speed control circuit in the present invention. A power failure detector 22 detects a power failure of a three-phase AC power source 1. A current measuring instrument 23 and a voltage measuring instrument 24 respectively measure an output current and an output voltage of an inverter 4. A car load measuring instrument 25 is arranged between the chamber of a car 8 and a bottom portion of a car frame and measures a car load. The charging-discharging state measuring device 14A has each of measuring instruments for measuring charging and discharging currents, charging and discharging voltages and a temperature of a power accumulating device 11. In the charging-discharging state measuring device 14A, each of these measuring values and a charging degree, i.e., a full charging state of the power accumulating device 11 is set to a reference, and a SOC (State Of Charge) as a value obtained by normalizing and accumulating a product of a charging-discharging current and a charging-discharging voltage by a capacity is outputted to the speed control circuit 21A. The speed control circuit 21A outputs speed commands for controlling a speed of the elevator to the inverter 4 in a range of discharging ability power of the power accumulating device 11 at a detecting time of the power failure during running of the elevator on the basis of a power failure detecting signal from the power failure detector 22 or the voltage measuring instrument 18, charging and discharging states from the charging-discharging state measuring device 14A, a speed feedback signal from an encoder 20, each of measuring values from the current measuring instrument 22 and the voltage measuring instrument 23, and a car load measuring value from a car load measuring instrument.

Figure 2:
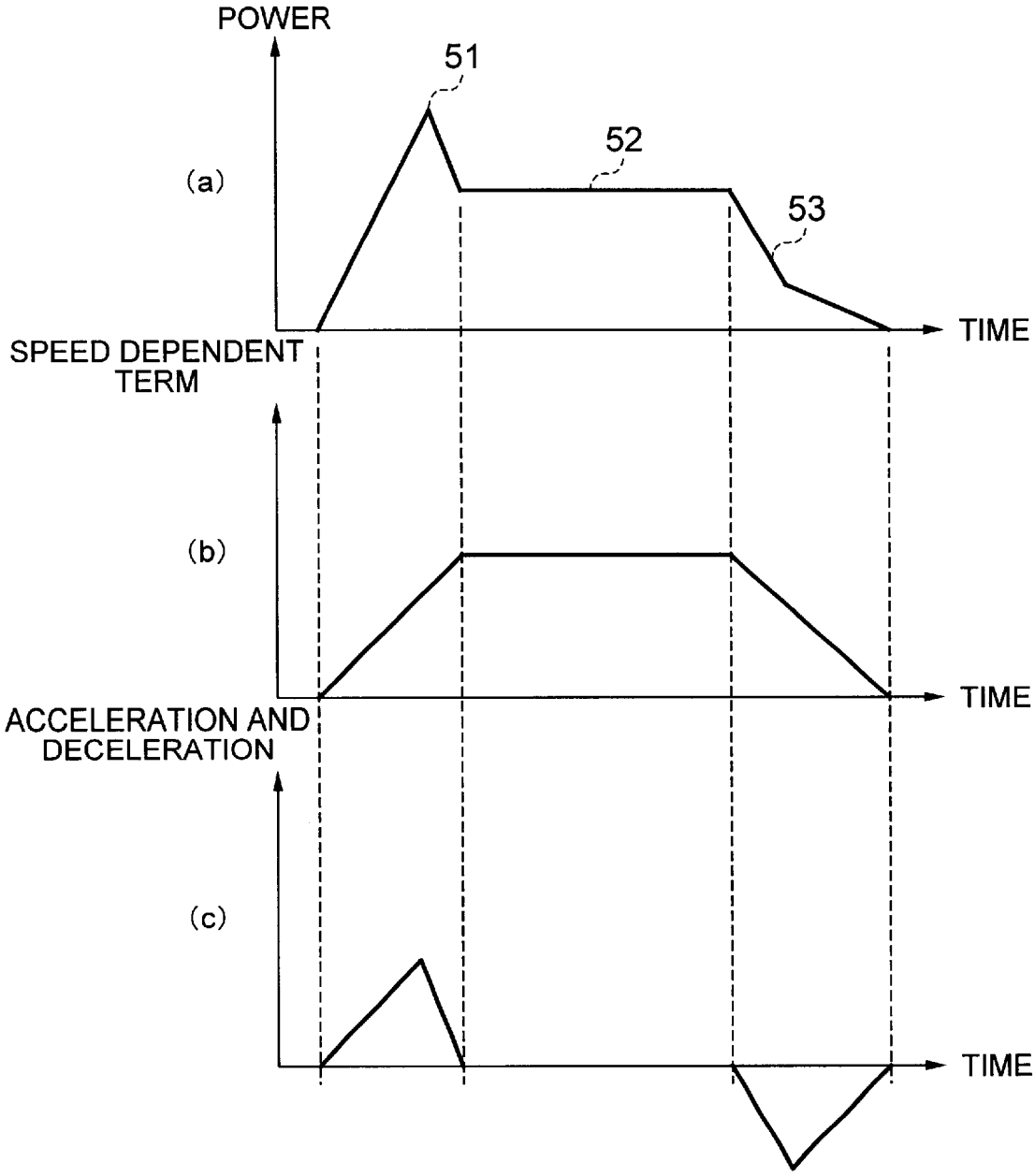
FIG. 2 is a view used to explain speed control at a power failure time in this invention and showing a power waveform during a power operation of the elevator with a time axis as the abscissa.

FIG. 2 is a view used to explain speed control at a power failure time in this invention and showing a power waveform at a power running operation time of the elevator with a time axis as an axis of abscissa.

A power waveform as shown in FIG. 2 (refer (a)) is obtained in the case of full load riding of the elevator and a power running operation such as an ascending direction operation time, etc. Power approximately becomes a total of a power amount depending on the speed of the elevator as shown in FIG. 2 (refer (b)) and a power amount depending on acceleration and deceleration as shown in FIG. 2 (refer (c)). A power curve becomes a peak (51) during acceleration near a highest speed, and becomes a constant voltage (52) at a constant speed, and power is reduced (53) as deceleration is started. When the power accumulating device 11 is designed such that all power can be also supplied from the power accumulating device 11 even at the power failure time, the power accumulating device 11 becomes expensive. Accordingly, when there is no power supply from the three-phase AC power source 1 in the power failure, etc., the supply power becomes insufficient near maximum power as in an ascending operation, etc. in a full load.

In this invention, smooth speed control is also embodied by the speed control circuit 21A even at the power failure time by using a cheap power accumulating device 11 of a low capacity.

Each of concrete embodiments will next be explained.

Embodiment Mode 1

In this embodiment mode 1, the speed control circuit 21A performs the speed control at the power failure time on the basis of a power failure detecting signal of the power failure detector 22. As shown in FIG. 3, at the same time the speed control circuit 21A has a table T1 in which required power according to a load and a speed of the car is set. Required power Ws at the present speed and a constant speed running time is calculated by using this table T1. Further, discharging ability power Wo from the power accumulating device 11 is set as a fixed value.

Figure 4:
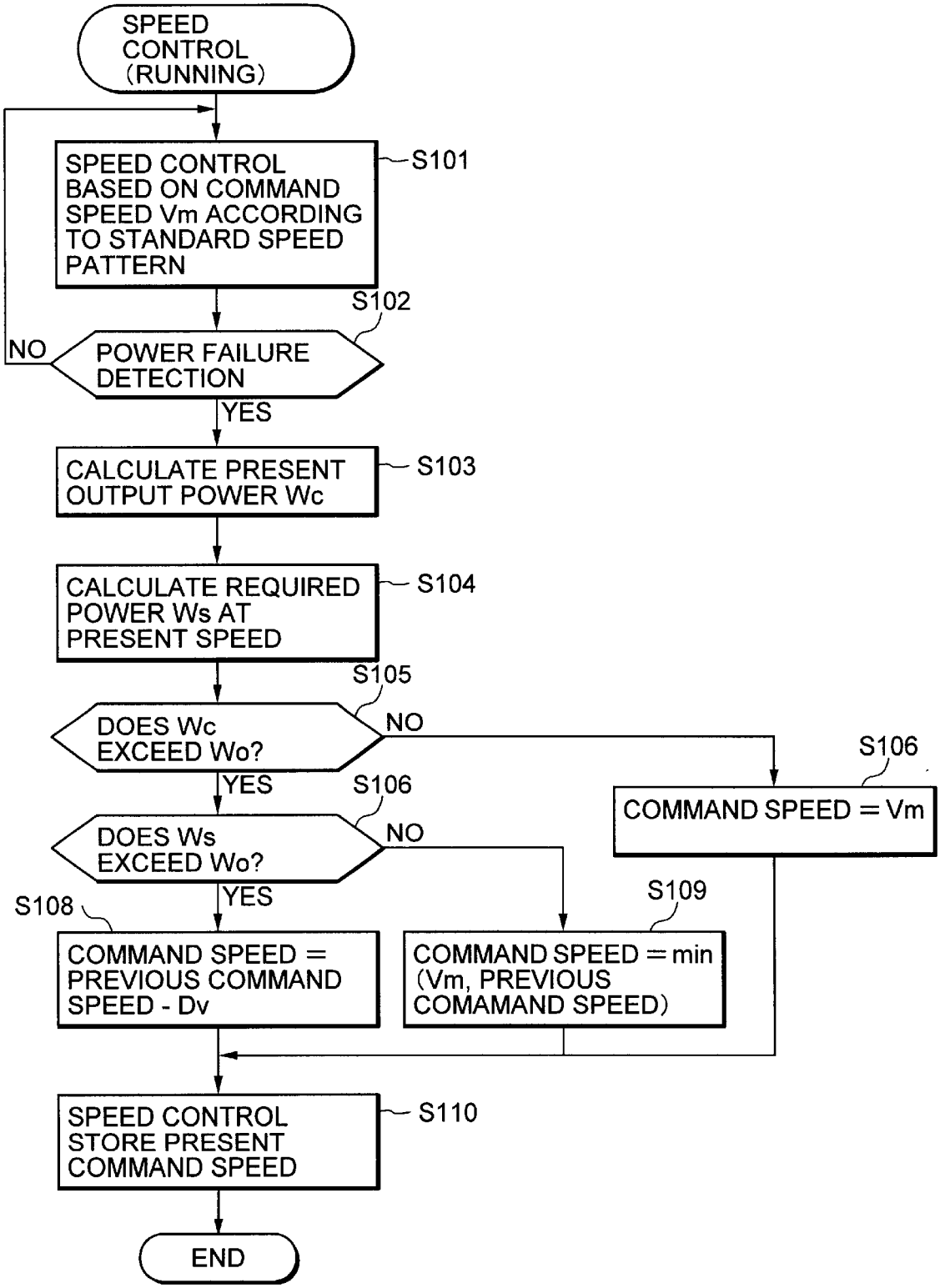
FIG. 4 is a flow chart showing control of the speed control circuit in the embodiment 1 of this invention.

Control of the speed control circuit 21A in the embodiment mode 1 of this invention will next be explained with reference to a flow chart shown in FIG. 4.

First, a command speed Vm in a normal state in accordance with a predetermined standard speed pattern is outputted to the inverter 4 and the speed of the elevator is controlled (step S101). In this state, when a power failure detecting signal is inputted from the power failure detector 22, the present output power Wc is calculated on the basis of measuring values of an output current and an output voltage of the inverter 4 from the current measuring instrument 23 and the voltage measuring instrument 24 (step S102→S103). Further, when no power failure detecting signal is inputted, the speed of the elevator is controlled on the basis of the command speed Vm in the normal state in accordance with the standard speed pattern (step S102→S101).

The required power Ws at the present speed is also calculated (step S104). It is difficult to analytically calculate this required power Ws and, generally it is simple and convenient that a table setting the required power Ws at a suitable partition speed is made with respect to each load state of the elevator, and the required power Ws is retrieved from the table. Here, the speed control circuit 21A calculates the required power Ws at the present speed and the constant speed running time from the table T1 as shown in FIG. 3 on the basis of a car load measuring value from the car load measuring instrument 25 and a speed feedback signal from the encoder 20.

In the speed control circuit 21A, the discharging ability power Wo from the power accumulating device 11 is set as a fixed value. It is first judged whether the present output power Wc exceeds the discharging ability power Wo or not. If the present output power Wc does not exceed the discharging ability power Wo, there is still a margin of speed rising and the elevator can be accelerated in an original speed curve. Therefore, the command speed is set to the command speed Vm according to the standard speed pattern (step S105→S106).

In contrast to this, if the present output power Wc exceeds the discharging ability power Wo, two cases are considered. One case is a case in which the speed itself is excessively high. In this case, it is necessary to decelerate the elevator. The other case is a case in which the speed itself is preferable, but power is excessive to accelerate the elevator. In this case, it is necessary to maintain the present speed.

Namely, it is judged whether the present output power Ws exceeds the discharging ability power Wo or not. If the present output power Ws exceeds the discharging ability power Wo, a new command speed is calculated by subtracting a deceleration set value Dv from the previous command speed (step S107→S108).

In contrast to this, when the present output power Ws does not exceed the discharging ability power Wo, the command speed is set to a command speed of a smaller value of either the command speed Vm according to the standard speed pattern or the previous command speed (step S107→S109).

The speed control is performed on the basis of the command speed calculated in this way, as well as storing the calculated command speed to a built-in memory to prepare for the next calculation of the command speed (step S110).

Therefore, when a power failure is detected, the elevator can be smoothly operated by controlling the speed of the elevator within a range of the discharging ability power from the power accumulating device 11. Accordingly, even when the power failure is caused after running of the elevator is started, the elevator can continuously run without stopping the running.

Further, in the above flow chart, the elevator is abruptly decelerated when the present required power Ws exceeds the discharging ability power Wo (step S107→S108). However, if processing such as smoothing with respect to the deceleration, etc. is performed in accordance with the present accelerating and decelerating states, the speed pattern becomes even more smoother.

Accordingly, in accordance with the above embodiment mode 1, the speed of the elevator can be stably controlled in the power failure of the three-phase AC power source 1 in a range in which no excessive burden is imposed on the secondary battery 12 at a discharging time from the power accumulating device 11. Therefore, a cheap power accumulating device 11 with a long life can be constructed.

Embodiment Mode 2

In this embodiment mode 2, as shown in FIG. 5, the speed control circuit 21A detects the power failure on the basis of a measuring voltage of a bus voltage provided by the voltage measuring instrument 18, and has a table T2 in which a limited discharging current is set with respect to a discharging current and a discharging voltage. Discharging ability power of the power accumulating device 11 is calculated by using this table T2.

FIG. 5 shows an example of the table for limiting the discharging current on the basis of the voltage of the power accumulating device 11 at its discharging time. In this example, a limited output of limited power is made by data from a measuring device and the above table. In this table, the present discharging current is a discharging current of the secondary battery 12 outputted from the power accumulating device 11 at present. When this electric current flows, the discharging voltage of the secondary battery 12 is measured and the limited discharging current of a voltage equal to or greater than a voltage in a voltage column is described in the item of a limited current. For example, there is particularly no limited current if the present discharging current is equal to or greater than A1 ampere and the discharging voltage is equal to or greater than V11 volt. However, if the discharging voltage lies between V11 volt and V12 volt, the discharging current is limited to A12 ampere. When the discharging voltage is equal to or smaller than V12 volt, a table describing discharging inhibition, etc. is used. Naturally, if the table is set in further detail, more preferable results are obtained. Since the speed control is performed in view of these results, a delay is inevitably caused. Therefore, it is necessary to design the table with a margin. It is simple to multiply the present voltage by this limited current and set it to limited power.

Namely, in this embodiment mode 2, the power failure of the three-phase AC power source 1 is detected by monitoring an input voltage (DC bus voltage) to the inverter 4. Accordingly, no device of a special kind is additionally required and the controller can be cheaply constructed. The voltage of the DC bus 3 is determined at a point at which power supplied from the three-phase AC power source 1 and output power from the power accumulating device 11 are merged at a time except for the power failure time. However, when the power failure occurs, the power supply from the three-phase AC power source 1 is stopped. Therefore, only the output power from the power accumulating device 11 is supplied so that no power equal to or greater than constant power is supplied. However, when required power of the inverter 4 becomes constant, the DC bus voltage is reduced at this time point. Accordingly, a power failure state can be detected by monitoring the voltage of the DC bus 3 without arranging any special device. If the power failure is detected, similar to the above example, the required power on a side of the inverter 4 is set to power able to be supplied by deceleration, etc. so that a stable operation can be subsequently performed.

Figure 6:
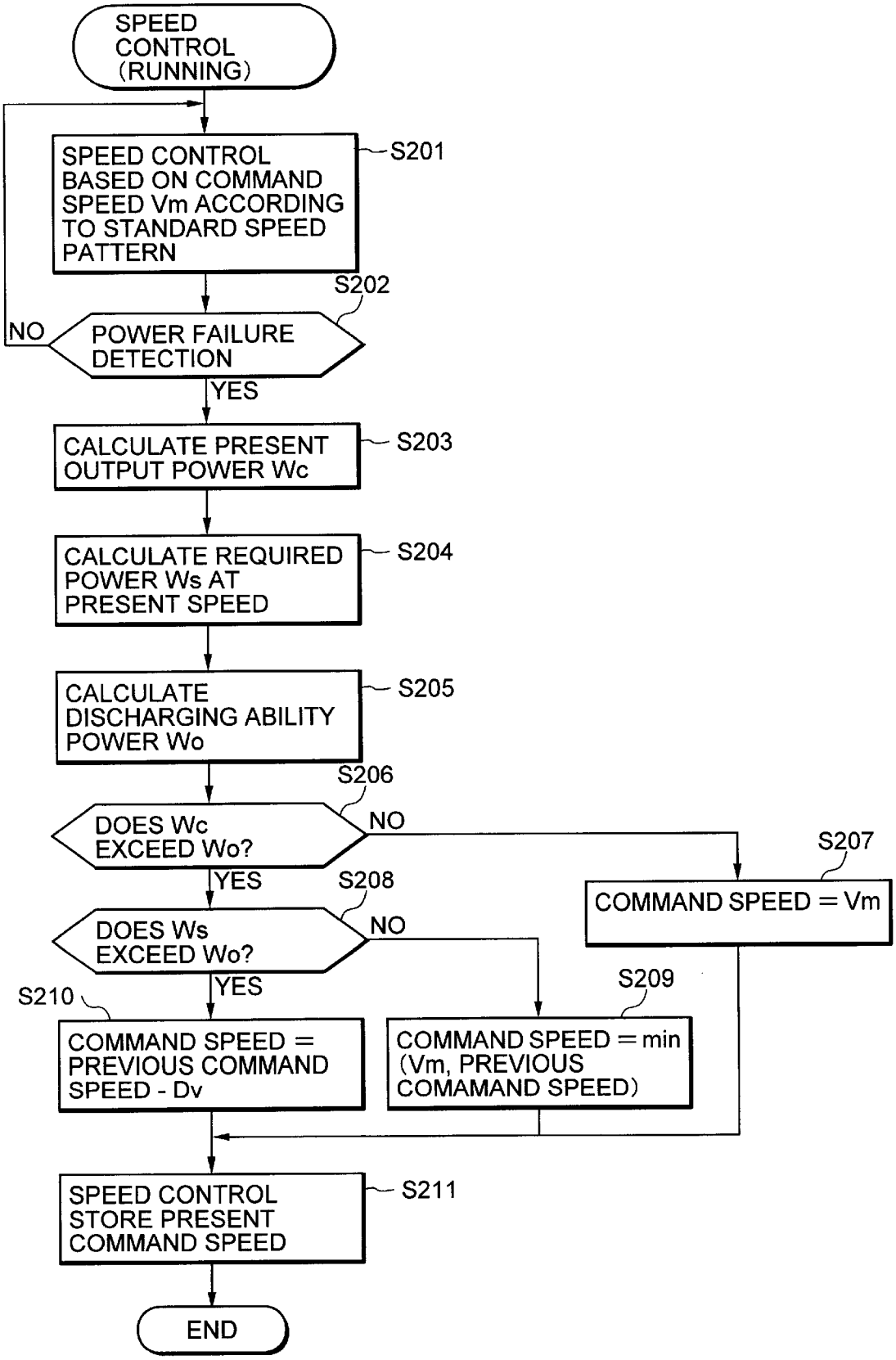
FIG. 6 is a flow chart showing control of the speed control circuit in the embodiment 2 of this invention.

Control of the speed control circuit 21A in the embodiment mode 2 of this invention will next be explained with reference to a flow chart shown in FIG. 6.

First, the command speed Vm in the normal state in accordance with the predetermined standard speed pattern is outputted to the inverter 4 and the speed of the elevator is controlled (step S201). In this state, when a power failure is detected on the basis of an output voltage of the voltage measuring instrument 18, the present output power Wc is calculated on the basis of measuring values of an output current and an output voltage of the inverter 4 from the current measuring instrument 23 and the voltage measuring instrument 24 (step S202→S203). Further, when no power failure detecting signal is inputted, the speed of the elevator is controlled on the basis of the command speed Vm in the normal state in accordance with the standard speed pattern (step S202→S201).

Similar to the embodiment mode 1, the speed control circuit 21A then calculates the required power Ws at the present speed and the constant speed running time from the table T1 as shown in FIG. 3 on the basis of a car load measuring value from the car load measuring instrument 25 and a speed feedback signal from the encoder 20 (step S204).

Further, a limited discharging current according to the present discharging current and voltage is calculated from the table T2 shown in FIG. 5 on the basis of measuring values of the present discharging current and voltage from the charging-discharging state measuring device 14A. Discharging ability power Wo of the power accumulating device 11 is calculated from a product of the calculated limited discharging current and the measuring value of the discharging voltage (step S205).

It is then judged whether the present output power Wc exceeds the discharging ability power Wo or not. If the present output power Wc does not exceed the discharging ability power Wo, there is still a margin of speed rising and the elevator can be accelerated in an original speed curve. Therefore, the command speed is set to the command speed Vm according to the standard speed pattern (step S206→S207).

In contrast to this, if the present output power Wc exceeds the discharging ability power Wo, two cases are considered. One case is a case in which the speed itself is excessively high. In this case, it is necessary to decelerate the elevator. The other case is a case in which the speed itself is preferable, but power is excessive to accelerate the elevator. In this case, it is necessary to maintain the present speed.

Namely, it is judged whether the present output power Ws exceeds the discharging ability power Wo or not. If the present output power Ws exceeds the discharging ability power Wo, a new command speed is calculated by subtracting a deceleration set value Dv from the previous command speed (step S208→S209).

In contrast to this, when no present output power Ws does not exceed the discharging ability power Wo, the command speed is set to a command speed of a smaller value of either the command speed Vm according to the standard speed pattern or the previous command speed (step S208→S210).

The speed control is performed on the basis of the command speed calculated in this way, as well as storing the calculated command speed to a built-in memory to prepare for the next calculation of the command speed (step S211).

Accordingly, in accordance with the above embodiment mode 2, the power failure of the three-phase AC power source 1 is detected on the basis of the voltage measurement of the DC bus 3, and the speed of the elevator can be stably controlled in a range in which no excessive burden is imposed on the secondary battery 12 at a discharging time from the power accumulating device 11. Therefore, a cheap power accumulating device 11 with a long life can be constructed.

Embodiment modes 3 and 4 will next be explained. In these embodiment modes, the speed control circuit 21A detects a power failure on the basis of a measuring voltage of the bus voltage provided by the voltage measuring instrument 18 or a detecting signal of the power failure detector 22, and discharging ability power of the power accumulating device 11 is calculated on the basis of a measuring output from the charging-discharging state measuring device 14A. An operation of the speed control circuit 21A in these embodiment modes 3 and 4 is similar to that in the embodiment mode 2 in accordance with a flow chart shown in FIG. 6.

Embodiment Mode 3

In the embodiment mode 3, the speed control circuit 21A detects a power failure on the basis of a measuring voltage of the bus voltage provided by the voltage measuring instrument 18 or a detecting signal of the power failure detector 22. Further, as shown in FIG. 7 the speed control circuit 21A has a table T3 in which a limited discharging current is set with respect to a temperature of the secondary battery 12 of the power accumulating device 11. The limited discharging current is calculated from the above table T3 on the basis of a measuring value of the temperature of the secondary battery 12 from the charging-discharging state measuring device 14A. Discharging ability power of the power accumulating device 11 is calculated from the calculated limited discharging current and a measuring value of the discharging voltage.

Embodiment Mode 4

In the embodiment mode 4, as shown in FIG. 8, the speed control circuit 21A has a table T4 in which a limited discharging current is set with respect to a charging degree SOC as a value provided by normalizing and accumulating a product of a charging-discharging current and a charging-discharging voltage by a capacity with a full charging state of the power accumulating device 11 as a reference. The limited discharging current is calculated from the table T4 on the basis of the charging degree SOC obtained on the basis of measuring values of the discharging current and the discharging voltage from the charging-discharging state measuring device 14A. Discharging ability power of the power accumulating device 11 is calculated from the calculated limited discharging current and a measuring value of the discharging voltage.

Embodiment Mode 5

In the embodiment mode 5, the speed control circuit 21A has a table T5 in which a speed pattern according to a load state is set as shown in FIG. 9. A speed pattern (e.g., V01, V02, V03, . . . , V0n) is calculated from the table T5 on the basis of a car load measuring value measured by the car load measuring instrument 25 so that speed commands are generated in accordance with the calculated speed pattern. This embodiment mode 5 can be applied to the embodiment modes 1 to 4.

Namely, FIG. 9 shows a table of the speed pattern of speed control in the embodiment mode 5, and this table shows a speed pattern at an accelerating time. Smooth acceleration can be realized by using this table in a pattern in which a speed at each of times t1, t2, t3, . . . , tn after departure is described. This acceleration table T5 is separately arranged on each of ascending and descending operation sides. A deceleration pattern table corresponding to the above acceleration is used on a deceleration side although this deceleration pattern table is not described here. However, in this table, it is general to use a speed table with respect to the remaining distance until stoppage instead of speed with respect to time. In FIG. 9, no load and % load, etc. show patterns with respect to the respective loads.

When a reduction in output of the power accumulating device 11 such as an excessive reduction in SOC level caused by a certain cause (including breakdown), etc. is known before departure, the elevator can be smoothly operated within a restriction of commercial power by operating the elevator in a preset speed pattern. In an operating pattern of the conventional elevator, no elevator has an operating pattern according to a load. Therefore, when the elevator is operated in the restriction range of commercial power, for example, a loadless ascending operation basically becomes a regenerative operation and no discharging from the power accumulating device 11 is required. In contrast to this, a power running operation is performed in a loadless descending operation so that consumed power is large. Thus, the elevator can be operated at an optimum speed by setting the speed table in accordance with loads and directions.

As mentioned above, in accordance with this invention, speed, acceleration, etc. of the elevator are changed at a failure time of commercial power in control of the elevator having the power accumulating device, but the speed of the elevator can be stably controlled. Therefore, it is possible to obtain a controller of the elevator in which smooth speed control can be also performed even at the power failure time by using a cheap power accumulating device of a low capacity.

What is claimed is:

1. A controller of an elevator comprising:

a converter for rectifying AC power from an AC power source and converting the AC power to DC power;

an inverter for converting the DC power from said converter to AC power having a variable voltage and a variable frequency and driving an electric motor operating an elevator;

DC buses connecting said converter to said inverter;

a power accumulating device arranged between said DC buses and accumulating DC power from said DC buses during regenerative operation of the elevator, and supplying accumulated DC power to said DC buses during powered operation of the elevator;

a charging-discharging control device for controlling charging and discharging of said power accumulating device with respect to said DC buses;

power failure detecting means for detecting a power failure;

current detecting means for detecting output current of said inverter;

voltage detecting means for detecting output voltage of said inverter;

car load measuring means in a car of the elevator and measuring load in the car;

speed detecting means for detecting operating speed of the elevator; and speed control means for controlling operation of said inverter to control speed of the elevator based on speed commands and the speed of the elevator detected by said speed detecting means, wherein said speed control means stores a first table with power set in accordance with the speed and the car load, output power of said inverter is calculated based on current detected by said current detecting means and voltage detected by said voltage detecting means during a power failure, using said power failure detecting means;

power required to operate the elevator is calculated from the table based on the load in the car measured by said car load measuring means and the speed detected by said speed detecting means; and speed commands for speed control are calculated within a range of discharging ability of said power accumulating device based on comparison of the output power of said inverter calculated, the power required, and the discharging ability of said power accumulating device.

2. The controller of an elevator according to claim 1, wherein a fixed value is set as the discharging ability of said power accumulating device in said speed control means.

3. The controller of an elevator according to claim 1, further comprising charging-discharging state measuring means for measuring at least one of temperature, charging and discharging currents, and charging and discharging voltages of said power accumulating device, wherein said speed control means stores a second table with a discharging current limit set with respect to the discharging current and the discharging voltage, and the discharging current limit is calculated from the second table based on the discharging current and the discharging voltage measured by said charging-discharging state measuring means, and the discharging ability of said power accumulating device is calculated from the discharging current limit and the discharging voltage measured.

4. The controller of an elevator according to claim 3, wherein said speed control means stores a third table with the discharging current limit set with respect to the temperature, and the discharging current limit is calculated from the third table based on the temperature measured by said charging-discharging state measuring means, and the discharging ability of said power accumulating device is calculated from the discharging current limit and the discharging voltage measured.

5. A controller of an elevator according to claim 3, wherein said speed control means stores a third table with the discharging current limit set with respect to a charging degree obtained by normalizing and accumulating products of charging and discharging currents and charging and discharging voltages, with a fully charged state of said power accumulating device as a reference, and the discharging current limit is calculated from the third table based on the charging degree obtained, based on the discharging current and the discharging voltage measured by said charging-discharging state measuring means, and the discharging ability of said power accumulating device is calculated from the discharging current limit and the discharging voltage measured.

6. The controller of an elevator according to claim 1, wherein said speed control means includes a memory storing a table with a speed pattern set in accordance with the load in the car, and the speed pattern is calculated from the table based on the load in the car measured by said car load measuring means, and the speed commands according to the calculated speed pattern are generated in response.

7. The controller of an elevator according to claim 1, wherein said power failure detecting means detects failure of the AC power source.

8. The controller of an elevator according to claim 1, wherein said power failure detecting means detects a power failure based on a voltage across said DC buses.

9. The controller of an elevator according to claim 1, wherein said speed control means continues acceleration if the elevator is accelerated when the discharging ability of said power accumulating device is larger than the output power of said inverter.

* * * * *